US006220185B1

(12) United States Patent
Pontoppidan

(10) Patent No.: US 6,220,185 B1
(45) Date of Patent: Apr. 24, 2001

(54) TABLE, IN PARTICULAR FOR VIDEO WORKSTATIONS

(75) Inventor: Eskild Pontoppidan, Kopenhagen (DK)

(73) Assignee: Fleischer Büromöbelwerk GmbH & Co. KG, Bochum (DE)

( * ) Notice: Subject to any disclaimer, the term of this patent is extended or adjusted under 35 U.S.C. 154(b) by 0 days.

(21) Appl. No.: 09/287,795

(22) Filed: Apr. 7, 1999

(51) Int. Cl.[7] ..... A47F 5/02
(52) U.S. Cl. ..... 108/147; 248/123.11
(58) Field of Search ..... 108/50.01, 2, 145, 108/147, 144, 146, 10; 248/123.11, 123.2, 125.2

(56) References Cited

U.S. PATENT DOCUMENTS 3,370,556 * 2/1968 Kooi ..... 108/146
4,351,245 * 9/1982 Laporte ..... 108/144
5,289,782 * 3/1994 Rizzi et al. ..... 108/147
5,311,827 * 5/1994 Greene ..... 108/147
5,400,721 * 3/1995 Greene ..... 108/147
5,682,825 * 11/1997 Manner ..... 108/144.11

FOREIGN PATENT DOCUMENTS 3817102 1/1989 (DE) .

* cited by examiner

*Primary Examiner*—Peter M. Cuomo
*Assistant Examiner*—Jerry A. Anderson
(74) *Attorney, Agent, or Firm*—Friedman Siegelbaum LLP

(57) ABSTRACT

The invention concerns a table, in particular for video workstations, having a height-adjustable tabletop with at least one vertical guide strut (2), furthermore having a table frame (3) with at least one table support (4) for the guide strut (2) which telescopes within it, and having at least one adjustable spring leg (5) which is arranged between the table frame (3) or the table support (4) and the height-adjustable table elements (1, 2) and has a spring. In addition, a measuring device (25) for determining the particular load on the tabletop (1) is provided, an adjusting device (9) for a spring-leg base (8) on an adjustable spring leg (5) being activated as a function of load values determined.

10 Claims, 5 Drawing Sheets

TABLE, IN PARTICULAR FOR VIDEO WORKSTATIONS

BACKGROUND

The invention relates to a table, in particular for video workstations, having a height-adjustable tabletop with at least one vertical guide strut, furthermore having a table frame with at least one table support for the guide strut which telescopes within it, and having at least one adjustable spring leg which is arranged between the table frame or the table support and the height-adjustable table elements and has a spring on the inside, the adjustable spring leg being coupled, with its one spring end, in a positionally fixed manner to the table frame or the table support and being supported, with its other spring end, in an adjustable manner against a spring-leg base which varies the pretension of the spring and is connected to the height-adjustable spring elements, and it being possible for the spring-leg base to be locked in positions matched to differing loads on the tabletop by means of an attached adjusting device.

A table of the type of design described at the beginning has been disclosed by DE 38 17 102 C2. Such a table can, of course, also be realized with a multiplicity of tabletops instead of one tabletop. Structures on top of the tabletop, such as, for example, shelving, cupboard elements etc. are also conceivable. The tabletop and guide strut (or guide struts) generally form the height-adjustable table elements whereas the table frame and table support remain fixed in position.

In the case of the known table, which the invention takes as the starting point, height adjustment is brought about by the tabletop being kept in suspension by means of the adjustable spring leg. For this purpose, use is made of the adjusting device which matches the spring-leg base to differing loads on the tabletop. In the case of the known teaching this matching is done in such a way that the adjusting device for the spring-leg base or the supported spring end of the adjusting spring leg is designed as a spindle drive with a handwheel or crank. All in all, a mounting which is, as it were, suspended is realized for a height-adjustable table whose tabletop can—because of the suspended state—be adjusted in height with minimum effort by a relevant operator. After the desired position of the tabletop has been reached, the latter is generally fixed via a (manually operable) locking brake.

The measures described above have proved their worth per se but, as far as the weight counterbalance or the reaching of the suspended state are concerned, are in need of improvement. For one thing, manual adjustment of the adjusting spring leg or of the spring-leg base thereof no longer meets today's requirements for convenience and, for another thing, inaccuracies are associated with the manual adjustment and, in particular, flexible and rapid matching to changing loads on the tabletop is achieved only with a great outlay. In addition, if the weight is not completely counterbalanced and the locking brake is released risks to the operator cannot be ruled out. This is where the invention comes in.

SUMMARY OF THE INVENTION

The invention is based on the object of developing a table, in particular for video workstations, of the type described at the beginning in such a manner that simple, convenient, safe and flexible matching to changing loads on the tabletop is made possible.

To achieve this object, in the case of a table of the generic type, in particular for video workstations, the invention proposes that a measuring device for determining the particular load on the tabletop is provided, and that the adjusting device is correspondingly activated as a function of load values determined. Generally, the measuring device and adjusting device form a closed control loop for this purpose. In addition, an open-loop control device for evaluating the load values supplied by the measuring device and for the corresponding activation of the adjusting device can be provided. This open-loop control device can, of course, also be a closed-loop control device. The measuring device is preferably designed as two or more switches which are assigned to a rotating rod, the rotating rod being connected to the guide strut and converting the vertical movements thereof into rotational movements, and rotations of the rotating rod being transmitted to the one switch or the other switch, depending on the direction of rotation of the rotating rod, via an attached connecting element, for example an extension arm. It should be emphasized that, according to the teaching of the invention, it is not only possible for the guide strut to carry out vertical movements in the sense of telescoping in the associated table support but it is also possible, of course, within the framework of the invention to carry out "oblique positions" of the guide strut, on the one hand, and the table support, on the other hand. In any case, such linear displacements of the guide strut in the table support are intercepted via the rotating rod and converted into corresponding rotational movements. The same is, of course, also true for the case in which—as is customary—at least two guide struts with associated table supports are realized.

In this connection, the extension arm can be attached to the rotating rod by means of a sliding bearing, and, when the rotating rod is rotated, can strike against the switches, which act as stops, with either the one switch or the other switch being struck, depending on the direction of rotation. This enables the simple and, at the same time, height-independent measurement of the particular load on the tabletop. This is because as long as the rotating rod strikes against a switch with its extension arm, it can be ascertained via this switch actuation that the tabletop is moved up or down by the guide strut. In order to ensure a corresponding weight counterbalance it is now— after the switch has been actuated—merely necessary additionally to activate the adjusting device in such a manner that the adjusting spring leg or a spring-leg base thereof is suitably positioned. For example, in the case of an upward movement of the tabletop by the guide strut it is to be assumed that the weight of the tabletop and any objects lying on it is overcompensated, with the result that the pretension of the spring has to be reduced by means of the adjusting device and the spring-leg base which can be varied thereby. This takes place until the extension arm strikes against the other switch and consequently the weight is (under) compensated and the extension arm alternately abuts or strikes against both switches.

In the event of the tabletop being moved downward by the guide strut, the procedure is carried out in a correspondingly opposing manner, i.e. the pretension of the adjustable spring leg is increased in order to counterbalance the weight undercompensation which is present here. It is always ensured that a (vertical) movement of the tabletop -with the locking brake released corresponds to corresponding variations of the spring-leg base so that the weight is counterbalanced in a simple, convenient and flexible manner. This is of particular importance nowadays since the service life of tables, in particular video workstation tables or else CAD tables, generally far exceeds the useful life of corresponding electronic (computer) components. Moreover, additional pieces of equipment are often required, and thus flexible matching to the weight ratios prevailing in each case on the tabletop is possible. In addition, particular emphasis must be given to the fact that operational safety can clearly be increased compared to the prior art. In actual fact, in the case of the known table and an insufficient weight counterbalance and also a released locking brake there is the risk of the tabletop—acted upon by the adjustable spring leg—leaping up and in the worst scenario being able to injure the operator. In any case, such risks no longer need to be feared since leaping up of the tabletop is automatically retarded or suppressed because such a vertical adjustment registers via the two switches and corresponding countermeasures in the form of changing the pretension of the spring are taken. The same is, of course, also true for the case in which the weight counterbalance has not been sufficient and the tabletop—without the measures according to the invention—would strike against the table support or the table frame. An automatic weight counterbalance is always achieved—without complex, manual adjusting operations.

Further measures which are essential for the invention are given below. The spring-leg base is generally designed as a curved rail and the adjusting device is designed as a spindle drive with an electric motor, the curved rail and the spindle drive being pivotably attached to a common coupling point, the spindle drive furthermore having a displaceable slide which can be moved by means of the electric motor and is intended for the adjustable spring end, and the curved rail being attached to the height-adjustable guide strut or the tabletop counter to the force of the spring by means of a flexible tensile means which can be coiled up and uncoiled on a driving roller. Of course, other driving concepts for the spindle drive or the displaceable slide, for example a hydraulic drive, are also conceivable within the framework of the invention.

The curved rail is preferably designed in the shape of a mirror-inverted L with a vertical limb and horizontal limb, the common coupling point of the curved rail and spindle drive being arranged on the head side of the vertical limb, and the tensile means being attached on the foot-edge side of the horizontal limb. The concept of vertical limb and horizontal limb also, of course, includes limbs in an oblique position, which limbs are not perpendicular to one another.

According to a particularly significant proposal of the invention two or more spring legs are provided, the one spring leg being arranged in the guide strut and being supported between the guide strut or tabletop and table support or table frame, and being adjusted for counterbalancing the weight of the tabletop (with the guide strut), and the other spring leg being designed as the adjustable spring leg and being coupled centrally to a horizontal crossbeam. This permits a particularly sensitive counterbalancing of the weight over an extraordinarily large area. This is initially ensured by the spring leg which is arranged in the spring strut and ensures the counterbalancing of the weight of the tabletop (with the guide strut). This spring leg serves, as it were, to counterbalance the "minimum weight" of the tabletop to be kept in suspension. Of course, this minimum weight can also include fixedly installed structures etc. This enables flexible matching to the particular installation and working conditions. The additional adjustable spring leg then ensures the so-called "fine counterbalancing of weight", i.e. that additional loads on the tabletop due to pieces of equipment, video display units etc. which have been placed on it can be counterbalanced.

The guide strut is generally of E-shaped design in cross section with two semicircular arches and a web connecting the semicircular arches. In contrast, the table support is generally essentially of rectangular design in cross section with indentations which are complementary to the semicircular arches for guide roller disks which are in each case arranged between the semicircular arches and indentations and are intended for vertically guiding the guide strut. This not only achieves a simple and precise and also smooth-running guiding of the guide strut in the table support but corresponding guide rails for the guide roller disks can be omitted since the respective external or internal profile of the guide strut or table support acts as appropriate designs of rails.

The invention is explained in more detail in the following with reference to a drawing which merely represents one exemplary embodiment; in the drawing:

DETAILED DESCRIPTION OF THE DRAWINGS

Figure 1:
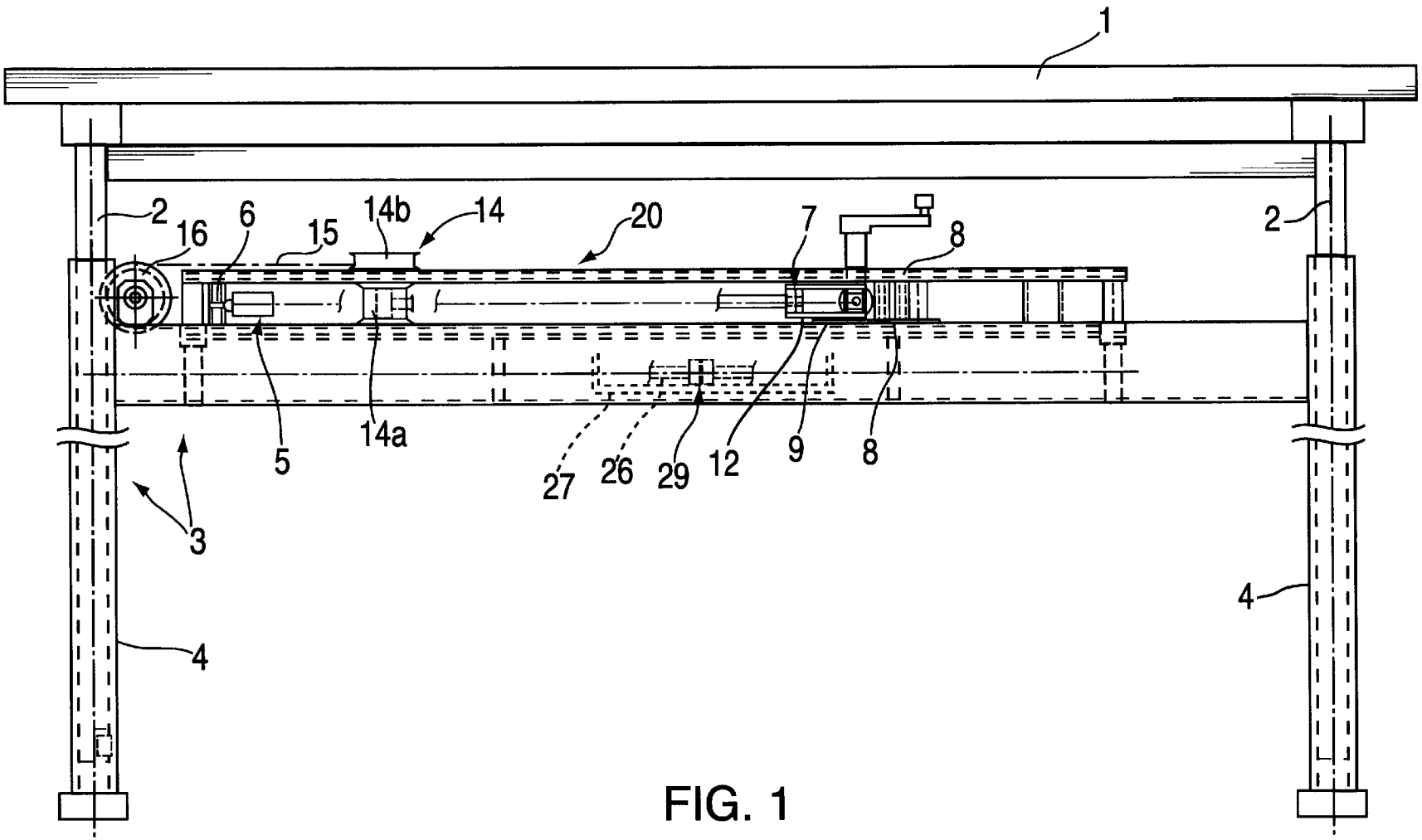
FIG. 1 shows a table according to the invention in a side view.

The figures show a table, in particular for video workstations and/or CAD workstations. In its basic design this table has a tabletop 1 with at least one vertical guide strut 2, a table frame 3 with at least one table support 4 for the guide strut 2 which telescopes within it, and also at least one adjustable spring leg 5 which is arranged between the table frame 3 or the table support 4 and the height-adjustable table elements 1, 2 and has a spring, in the exemplary embodiment a gas-filled spring. According to the exemplary embodiment two guide struts 2 and, accordingly, two associated table supports 4 are provided. The adjustable spring strut 5 is coupled, with its one spring end 6, in a positionally fixed manner to the table frame 3 or the table support 4. The adjustable spring leg 5 is supported, with its other spring end 7, in an adjustable manner against a spring-leg base 8 which varies the pretension of the spring and is connected to the height-adjustable spring elements 1, 2. The spring-leg base 8 can be locked in positions matched to differing loads on the tabletop 1 by means of an attached adjusting device 9.

The adjusting device 9 is a spindle drive 9 with an attached electric motor 10. The spring-leg base 8 is designed as a curved rail, the curved rail 8 and the spindle drive 9 being pivotably attached to a common coupling point. This coupling point is designed as a pivot bearing 11 and, at the same time, as an actuating shaft for the attached electric motor 10. By means of the electric motor 10, which is attached to the pivot bearing 11, the spindle drive 9, or a displaceable slide 13 which can be moved longitudinally on said spindle drive 9, can be adjusted via two bevel gearwheels 12 which interengage essentially at right angles. This displaceable slide 13 is connected to the adjustable spring end 7 (cf. in particular FIGS. 2 and 3). Should the electric motor 10 break down, manual adjustment via a crank is of course also conceivable, as indicated in FIG. 1.

Figure 2:
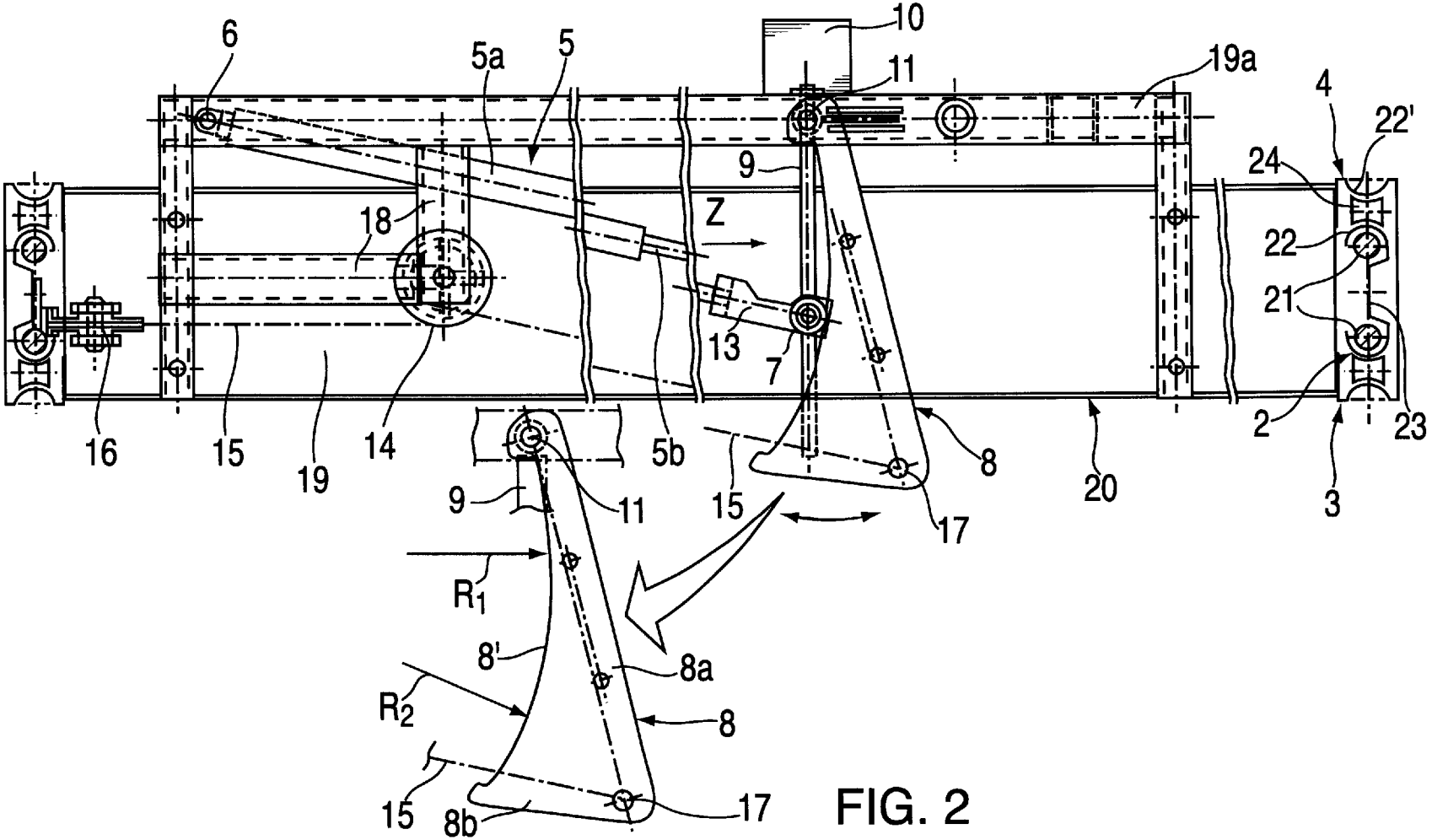
FIG. 2 shows a section through the table according to FIG. 1 in the region of a horizontal crossbeam.
Figure 3:
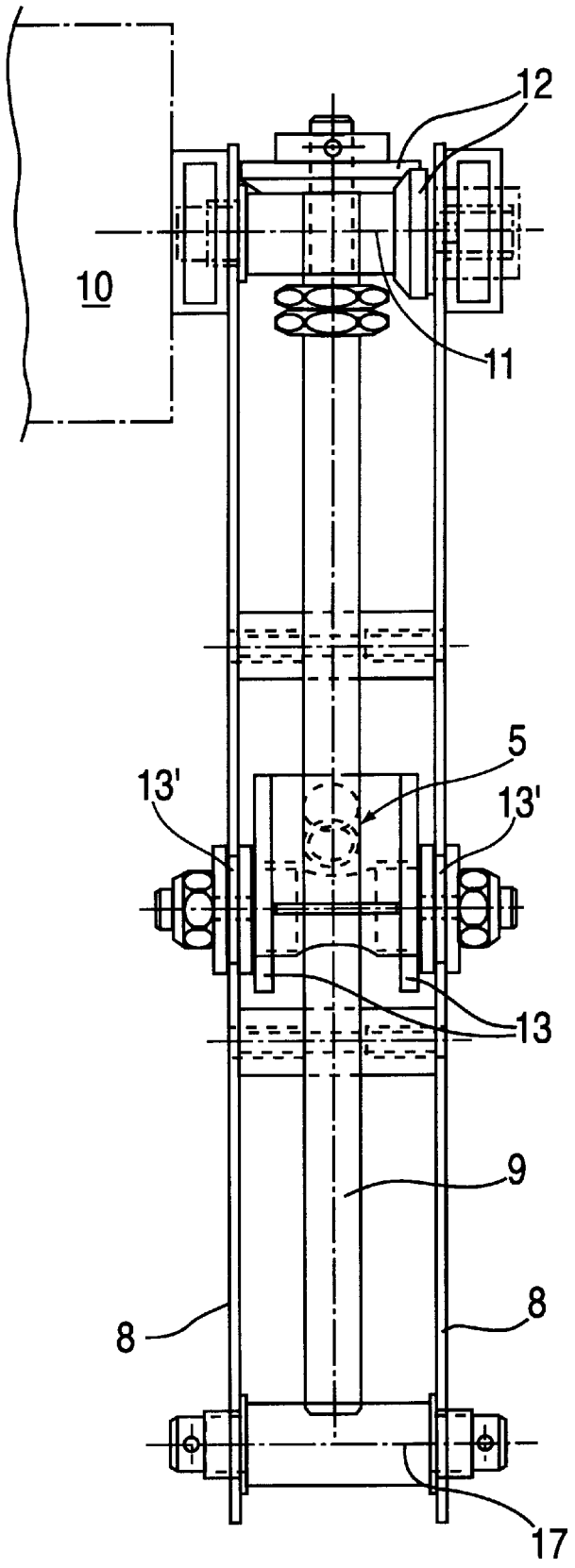
FIG. 3 shows a view from the direction Z in FIG. 2 of the adjustable spring-leg base.

FIG. 2 reveals that, when the electric motor 10 is activated, the displaceable slide 13 can be moved up and down along the spindle drive 9, guided by the curved rail 8. The shape of the curve 8' over which the displaceable slide 13 passes is selected in such a manner that in every position of the supported or adjustable spring end 7 the vertical force components which are effective in the guide strut 2 are at least essentially of equal size in both end positions of the tabletop 1. The result here is a procedure comparable to that described in DE 38 17 102 C2, to which reference is expressly made, in particular to the vector diagram in it of FIG. 3. In any case, with the adjustable spring end 7 being adjusted via the displaceable slide 13 it is ultimately possible to vary the pretension of the spring leg 5 or of the (gas-filled) spring, specifically in such a manner that, with the piston 5*b* of the spring leg 5 entering to an increased extent into a cylinder 5*a*, growing spring forces have to be overcome, the pretension consequently increases and therefore a corresponding weight on the tabletop 1 can be counterbalanced. According to the exemplary embodiment the curve 8' can be depicted by two circular arcs with differing radii $R_1$, $R_2$, $R_1$ being approximately 300 mm and $R_2$ approximately 200 mm.

The curved rail 8 is attached to the height-adjustable guide strut 2 (on the left-hand side in the exemplary embodiment) or to the tabletop 1 counter to the direction of force of the spring of the spring leg 5 by means of a flexible tensile means 15 which can be coiled up and uncoiled on a driving roller 14. In addition, a deflecting roller 16 is realized, which deflecting roller is fastened to the left guide support 4 or to the table frame 3 and ensures that vertical movements of the left guide strut 2 are converted into corresponding, horizontal extensions or contractions of the tensile means 15 via the driving roller 14, which extensions or contractions correspond to corresponding pivoting movements of the curved rail 8 (and, of course, also of the spindle drive 9) about the pivot bearing 11 (cf the arrow in FIG. 2). That is to say, in the event of the tabletop 1 moving downward, the deflecting roller 16 rotates anticlockwise (as can be seen in FIG. 1), which has the consequence that the driving roller 14 according to FIG. 2 moves clockwise and, via a coupling point 17 on the curved rail 8, results in the latter pivoting in the clockwise direction. Accordingly, the piston 5*b* enters to a greater extent into the cylinder 5*a*. In consequence, to counterbalance the weight during this type of movement of the tabletop 1, a corresponding pretension has to be ensured by means of the piston 5*b* entering to a greater depth into the cylinder 5*a*.

The driving roller 14 is coupled via extension arms 18 to a horizontal crossbeam 19 and to a U-shaped frame 19*a*. This horizontal crossbeam 19 serves to connect the table supports 4 and to accommodate the adjustable spring leg 5 which is attached to it via the U-shaped frame 19*a*. The driving wheel 14 is a twin roller with two different roller cores 14*a* and 14*b* which have different diameters. Altogether, the adjustable spring leg 5, the driving wheel 14, the curved rail 8 and the adjusting device 9 form a constructional unit and are combined in a U-shaped or box-shaped housing 20 with the driving wheel 14 lying on the outside or with the roller core 14*b* lying on the outside. The tensile means 15 is an endless steel cable 15. This steel cable 15 is, as it were, split in two and wound, on the one hand, onto the roller core 14*a* and, on the other hand, onto the roller core 14*b*.

In addition to the adjustable spring leg 5 which is shown, according to the exemplary embodiment four further spring legs 21 are realized, which spring legs are in each case arranged in the guide strut 2 and are supported between the guide strut 2 or tabletop 1 and the table support 4 or table frame 3. They are adjusted for counterbalancing the weight of the tabletop 1 with the guide strut 2. The guide strut 2 is of E-shaped design in cross section with two semicircular arches 22 and a web 23 connecting the semicircular arches 22. The four semicircular arches 22 enclose the spring legs 21 which have already been mentioned. It can be seen from FIG. 4, in particular, that the table support 4 is essentially of rectangular design in cross section with indentations 22' which are complementary to the semicircular arches 22 for guide roller disks 24 which in each case are arranged between the semicircular arches 22 and indentations 22' and are intended for the vertical guiding of the spring struts 2. The curved rail 8 has a twin rail design in the shape of a mirror-inverted L, the common coupling point 11 of the curved rail 8 and spindle drive 9 being arranged on the head side of the vertical limb 8*a*, and the tensile means 15 being attached in the coupling point 17 on the foot-edge side of the horizontal limb 8*b*. Grooved disks 13' are provided for guiding the displaceable slide 13 on the twin-rail curved rail 8 (cf. FIG. 3).

Figure 4:
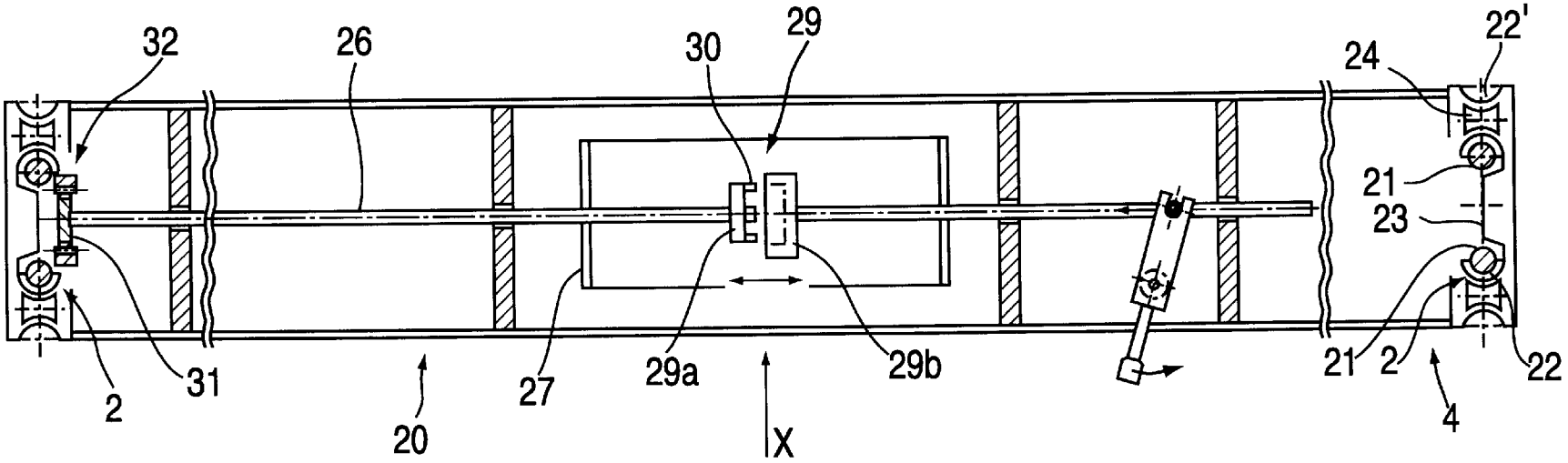
FIG. 4 shows a section through FIG. 1 in the region of the locking brake.
Figure 5:
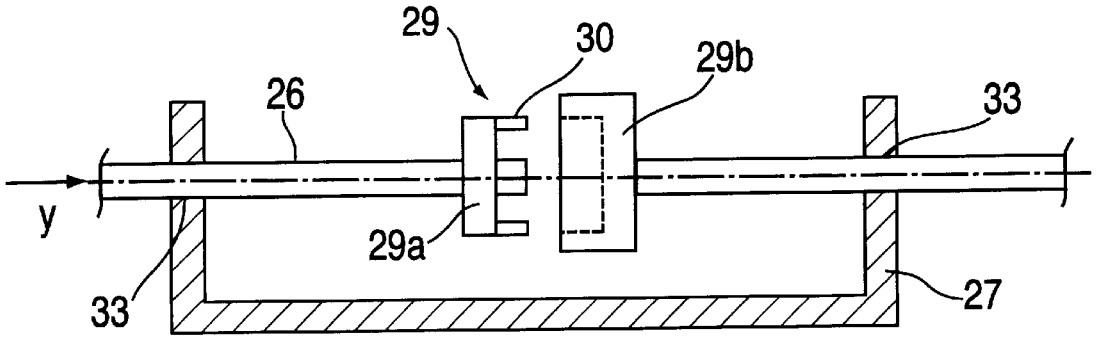
FIG. 5 shows a side view of FIG. 4 from the direction X.
Figure 6:
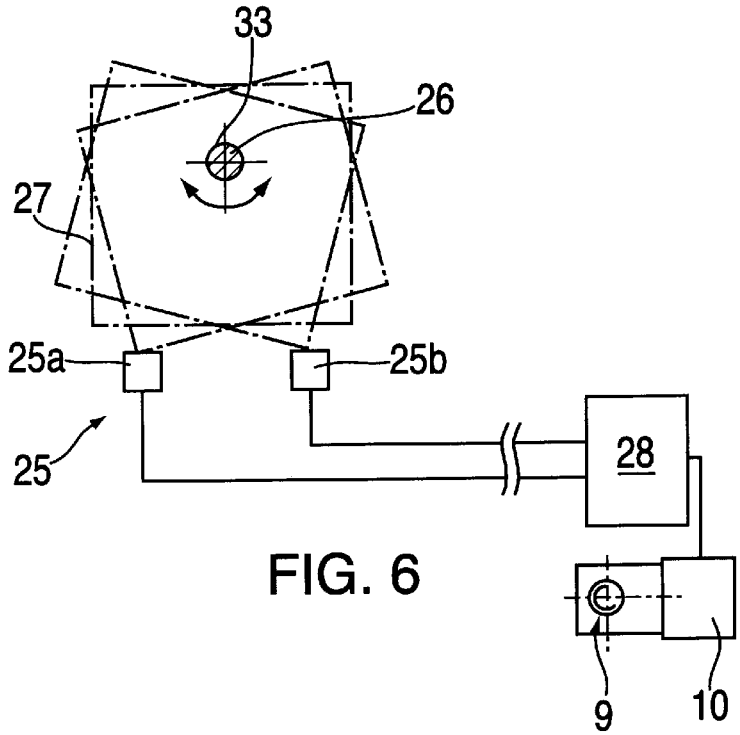
FIG. 6 shows a view from the direction Y in FIG. 5.

As shown in FIGS. 4 to 6, a measuring device 25 for determining the particular load on the tabletop 1 is provided. The adjusting device 9 is correspondingly activated as a function of load values determined. The measuring device 25 according to the exemplary embodiment comprises two switches 25*a*, 25*b* which are assigned to a rotating rod 26, the rotating rod 26 being connected to the guide strut 2 and converting the vertical movements thereof into rotational movements. According to the exemplary embodiment, the rotating rod 26 is arranged in a parallel horizontal plane below the horizontal crossbeam 19 (cf. FIG. 1). In this case, rotations of the rotating rod 26 are transmitted via an attached connecting element, according to the exemplary embodiment an extension arm 27, to the switches 25*a*, 25*b*, specifically to the one switch 25*a* or the other switch 25*b* depending on the direction of rotation of the rotating rod 26 (cf. FIG. 6). The measuring device 25 and the adjusting device 9 form a closed control loop, an open-loop control device (or closed-loop control device) 28 for evaluating the load values supplied by the measuring device 25 and for the corresponding activation of the adjusting device 9 being provided.

Figure 7:
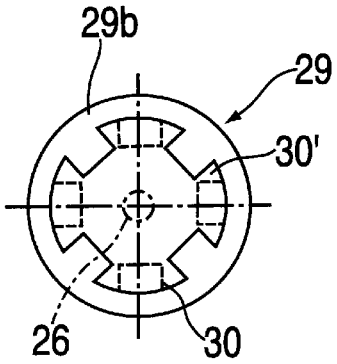
FIG. 7 shows a section through FIG. 5 in the region of the locking brake.

The rotating rod 26 according to the exemplary embodiment is a rod of the type which has a locking brake 29 on its end side. According to the exemplary embodiment, this locking brake 29 consists of a coupling gearwheel 29*a* which is connected to the rotating rod 26 and has end-side teeth 30 (cf. FIGS. 4 and 5) which engage into corresponding recesses 30' in a plastic, positionally fixed coupling bush 29*b* (cf. FIG. 7) when the coupling gearwheel 29*a* and coupling bush 29*b* are brought into engagement. This can take place by coupling or uncoupling the coupling bush 29*b* (cf. the arrow in FIG. 4). When the coupling gearwheel 29*a* is engaged into the coupling bush 29*b*, the tabletop 1 is secured because the rotating rod 26 engages, via an end-side gearwheel 31, into a rack pinion 32 in the left guide strut 2. Consequently, corresponding vertical movements of the guide struts 2 via the rack pinion 32 result in corresponding rotational movements of the rotating rod 26 via the gearwheel 31. With the aid of a linear adjusting device attached to the rotating rod 26 the coupling gearwheel 29*a* and coupling bush 29*b* can be moved apart from one another and toward one another and thus locked (cf. FIG. 4).

The extension arm 27 according to the exemplary embodiment is a retaining frame 27 which is U-shaped in longitudinal section and is intended for the locking brake 29, which frame is attached, by means of sliding bearings 33 in its two U-limbs, to the rotating rod 26 (cf. FIGS. 1 and 6). In any case, rotation of the rotating rod 26 results in the extension arm or retaining frame 27 pivoting into the positions shown by dashed-dotted lines in FIG. 6 (the position indicated by solid lines shows the rest position). The extension arm 27 is "carried along" in accordance with the rotational movements of the rotating rod 26, specifically via the friction between the sliding bearing 33 and rotational rod 26. This results—depending on the direction of rotation of the rotating rod 26—in the extension arm 27 striking against the one switch 25*a* or the other switch 25*b* (cf. FIG. 6). This allows the conclusion that the tabletop 1 is either over- or undercompensated in terms of weight. The corresponding measured values or the positions of the switches 25*a* and 25*b* are evaluated in the open-loop control device 28 and converted into adjusting signals for the adjusting device 9 so that the pretension of the adjustable spring leg 5 is correspondingly changed.

It should be emphasized that the constructional unit comprising the adjustable spring leg 5, driving wheel 14, curved rail 8, adjusting device 9 and, if appropriate, housing 20 can generally be used in any tables having an adjustable tabletop 1. In particular, it is conceivable to install the above-mentioned component complex as a retrofitted part or replacement part or to provide it and run it as an adjustable module. This also applies in conjunction with the measuring device 25, the rotating rod 26, the extension arm 27 and also the open-loop or closed-loop control device 28 in conjunction with the electric motor 10. The only further requirement is a corresponding connection or a matching of the tensile means 15 and, if appropriate, of the rotating rod 26 to the structural conditions. In any case, this inventive complex can be realized independently and used in general in any tables having an adjustable tabletop 1. It can even be envisaged using it in adjustable cupboards, chairs, table-like desks or high desks etc.

What is claimed is:

1. A table, comprising:

height-adjustable table elements comprising at least one vertical guide strut and a tabletop;

a table frame having at least one table support for the guide strut which telescopes within said table support;

at least one adjustable spring leg arranged between the table frame or the table support and the height-adjustable table elements and having a spring, wherein the adjustable spring leg is coupled:

with its one spring end in a positionally fixed manner to the table frame or the table support; and a spring-leg base supporting a second spring end, in an adjustable manner against the spring-leg base which varies the pretension of the spring and is connected to the height-adjustable spring elements, and an attached adjusting device, wherein wherein the spring-leg base can be locked in positions matched to a particular load on the tabletop by the attached adjusting device; and a measuring device for determining the particular load on the tabletop, wherein the adjusting device is correspondingly adjusted as a function of load values determined by said measuring device.

2. The table of claim 1, wherein the measuring device and the adjusting device form a closed control loop.

3. The table of claim 1, further comprising an open-loop control device for evaluating the load values supplied by the measuring device and for the corresponding activation of the adjusting device.

4. The table of claim 1, wherein the measuring device comprises two or more switches assigned to a rotating rod, wherein the rotating rod is connected to the guide strut and converts the vertical movements thereof into rotational movements, wherein rotations of the rotating rod are transmitted to a first of the two or more switches and then to a second or the other switch, depending on the direction of rotation of the rotating rod, via an attached connecting element, for example an extension arm.

5. The table of claim 4, further comprising a sliding bearing, wherein the extension arm is attached to the rotating rod by the sliding bearing and, wherein the rotating rod when rotated, strikes against the switches, which act as stops, with either the one switch or the other switch being struck, depending on the direction of rotation.

6. The table of claim 1, wherein the spring-leg base is designed as a curved rail and the adjusting device is designed as a spindle drive with an electric motor, and further comprising:

a common coupling point, wherein the curved rail and the spindle drive are pivotably attached to a common coupling point;

a displaceable slide of the spindle drive wherein the displaceable slide can be moved by the electric motor and is intended for the adjustable spring end; and a flexible tensile means, wherein the curved rail is attached to the height-adjustable guide strut or the tabletop counter to the force of the spring the flexible tensile means which can be coiled up and uncoiled on a driving roller.

7. The table of claim 1, wherein the curved rail is designed in the shape of a mirror-inverted L with a vertical limb and horizontal limb, wherein the common coupling point of the curved rail and spindle drive is arranged on the head side of the vertical limb, and wherein the tensile means is attached on the foot-edge side of the horizontal limb.

8. The table of claim 1, wherein two or more spring legs are provided, wherein:

one spring leg is arranged in the guide strut and supported between the guide strut or tabletop and the table support or table frame, and is adjusted for counterbalancing the weight of the tabletop; and the other spring leg is designed as the adjustable spring leg and is coupled centrally to a horizontal crossbeam.

9. The table of claim 1, wherein the guide strut is of E-shaped design in cross section design with two semicircular arches and a web connecting the semicircular arches.

10. The table of claim 1 wherein the table support is essentially of rectangular design in cross section with indentations which are complementary to the semicircular arches for guide roller disks which are arranged between the semicircular arches and indentations for vertically guiding the guide strut.

* * * * *